US007267600B1

(12) United States Patent
Lin et al.

(10) Patent No.: US 7,267,600 B1
(45) Date of Patent: Sep. 11, 2007

(54) POLISHING APPARATUS

(75) Inventors: Yu-Liang Lin, Hsin-Chu (TW); Jerry Hwang, Hsin Chu (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 11/423,553

(22) Filed: Jun. 12, 2006

(51) Int. Cl.
*B24B 49/00* (2006.01)

(52) U.S. Cl. ..... 451/5; 451/10; 451/11; 451/288; 451/910

(58) Field of Classification Search ..... 451/5, 451/41, 285, 287, 288, 910, 10, 11
See application file for complete search history.

(56) References Cited

U.S. PATENT DOCUMENTS 5,688,364 A * 11/1997 Sato ..... 438/693
6,196,900 B1 3/2001 Zhang et al.
6,561,868 B1 * 5/2003 Edwards et al. ..... 451/8
2002/0086624 A1 * 7/2002 Zuniga et al. ..... 451/56
2002/0151260 A1 * 10/2002 Crevasse et al. ..... 451/288
2003/0073391 A1 4/2003 Janzen
2004/0033769 A1 * 2/2004 Zuniga et al. ..... 451/398
2005/0239371 A1 * 10/2005 Togawa et al. ..... 451/5

* cited by examiner

*Primary Examiner*—Eileen P. Morgan
(74) *Attorney, Agent, or Firm*—Duane Morris LLP

(57) ABSTRACT

Apparatus for polishing are provided. An apparatus comprises a fluid controller, a polishing apparatus and a fluid interface membrane. The fluid controller is fluidly coupled to the polishing apparatus by way of at least one conduit. The fluid interface membrane is disposed within at least one of the fluid controller, the conduit and the polishing apparatus to separate a first fluid and a second fluid and to transfer pressure from the first fluid to the second fluid.

14 Claims, 5 Drawing Sheets

POLISHING APPARATUS

BACKGROUND OF THE INVENTION

1. Field of the Invention

The present invention relates to polishing apparatuses, and more particularly to chemical mechanical polishing (CMP) apparatus.

2. Description of the Related Art

With advances in electronic products, semiconductor technology has been applied widely in manufacturing memories, central processing units (CPUs), display devices, light emitting diodes (LEDs), laser diodes and other devices or chip sets. In order to achieve high-integration and high-speed, dimensions of semiconductor integrated circuits have been reduced, and various materials and techniques have been proposed to achieve these targets and overcome obstacles during manufacturing. Due to the high-integration of semiconductor integrated circuits, the topography of a semiconductor integrated circuit on a substrate becomes rough and the surface of the substrate should be planarized to facilitate deposition of subsequent layers. In order to solve this problem, chemical mechanical polishing (CMP) technology has been used.

FIG. 1 is a schematic drawing showing a prior art CMP apparatus. The apparatus includes an upper pneumatic assembly (UPA) 110, conduits 140 and a CMP head 130. The UPA 110 is connected to the CMP head 130 by way of the conduits 140. The CMP head 130 is seated on a platen 120 with a pad 125. The CMP head 130 confines a substrate 150 therein while the substrate 150 is polished. Air 113 is provided into the UPA 110 by way of a conduit 115. The UPA 110 controls the pressure of the air 113 in the conduits 140 to control downward forces applied to a membrane 131, a retaining ring 133 and an inner tube 135 of the CMP head 130. By way of the conduits 140, the pressure of the air 113 is directed to apply the downward force by way of the membrane 131 on the backside of the substrate 150 for polishing the surface of the substrate 150. Because the downward force is dominated by the air pressure, it is difficult to control the downward force and obtain a low downward force for polishing a low-k dielectric material layer. Further, the downward force created by the air pressure may cause a non-uniform profile on the top surface of the substrate 150.

By way of background, U.S. Pat. No. 6,196,900 describes an ultrasonic transducer slurry dispensing device and method for distributing slurry. The ultrasonic transducer transmits energy to the slurry for polishing.

U.S. Patent Publication No. 2003/0073391 describes a method and system for cleaning conditioning devices used in CMP system. An ultrasonic tank contains a liquid for the purpose of removing particles.

However, these references do not address the issue of the downward force for polish that causes a non-uniform profile on the surface of the substrate.

From the foregoing, improved CMP apparatus is desired.

SUMMARY OF THE INVENTION

In accordance with some embodiments, an apparatus comprises a fluid controller, a polishing apparatus and a fluid interface membrane. The fluid controller is fluidly coupled to the polishing apparatus by way of at least one conduit. The fluid interface membrane is disposed within at least one of the fluid controller, the conduit and the polishing apparatus to separate a first fluid and a second fluid and to transfer a pressure of the first fluid to the second fluid.

The above and other features will be better understood from the following detailed description of the preferred embodiments of the invention that is provided in connection with the accompanying drawings.

BRIEF DESCRIPTION OF THE DRAWINGS

Following are brief descriptions of exemplary drawings. They are mere exemplary embodiments and the scope of the present invention should not be limited thereto.

DESCRIPTION OF THE PREFERRED EMBODIMENT

Figure 1:
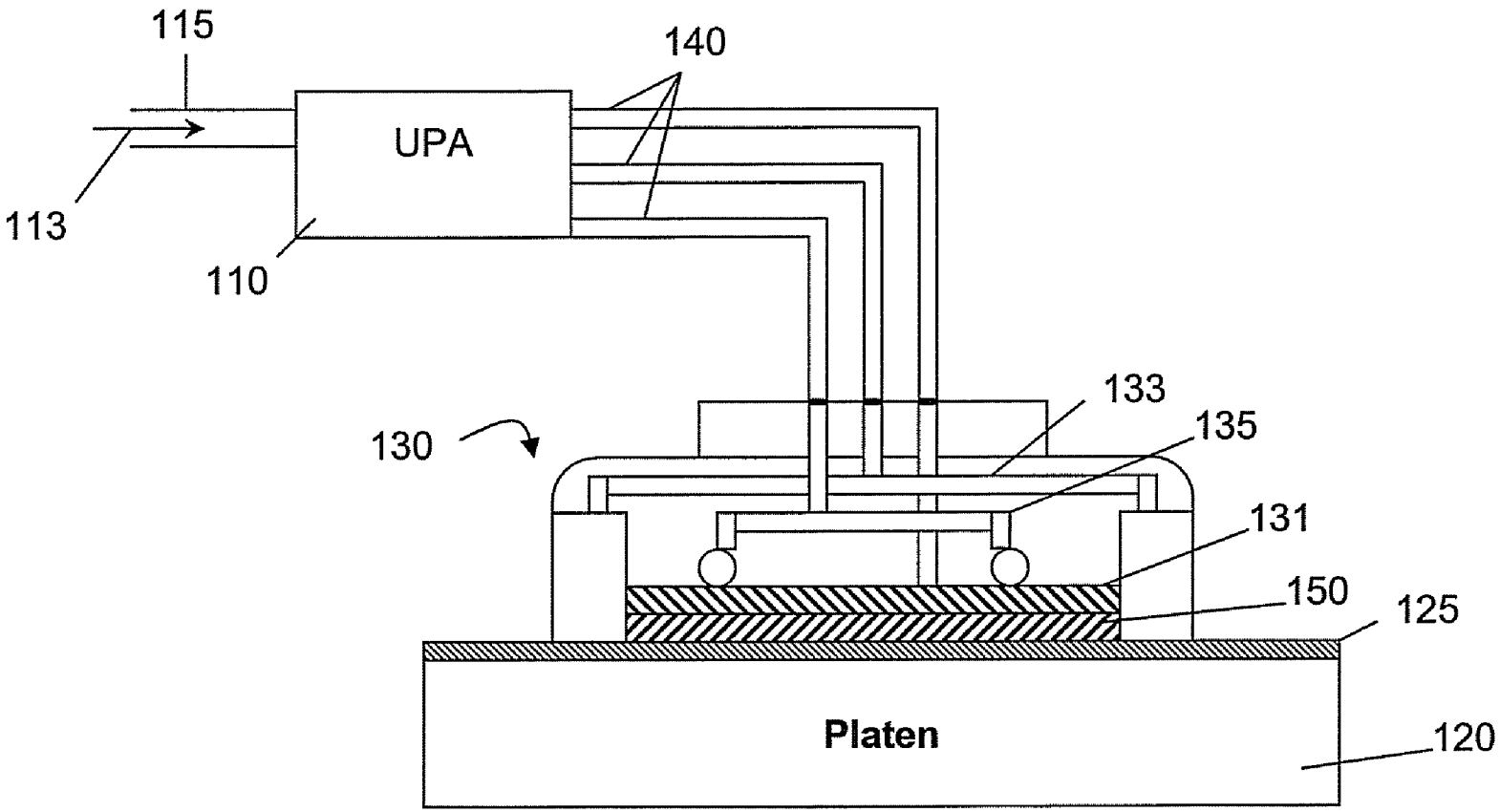
FIG. 1 (PRIOR ART)
FIG. 1 is a schematic drawing showing a prior art CMP apparatus.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation.

Figure 2A:
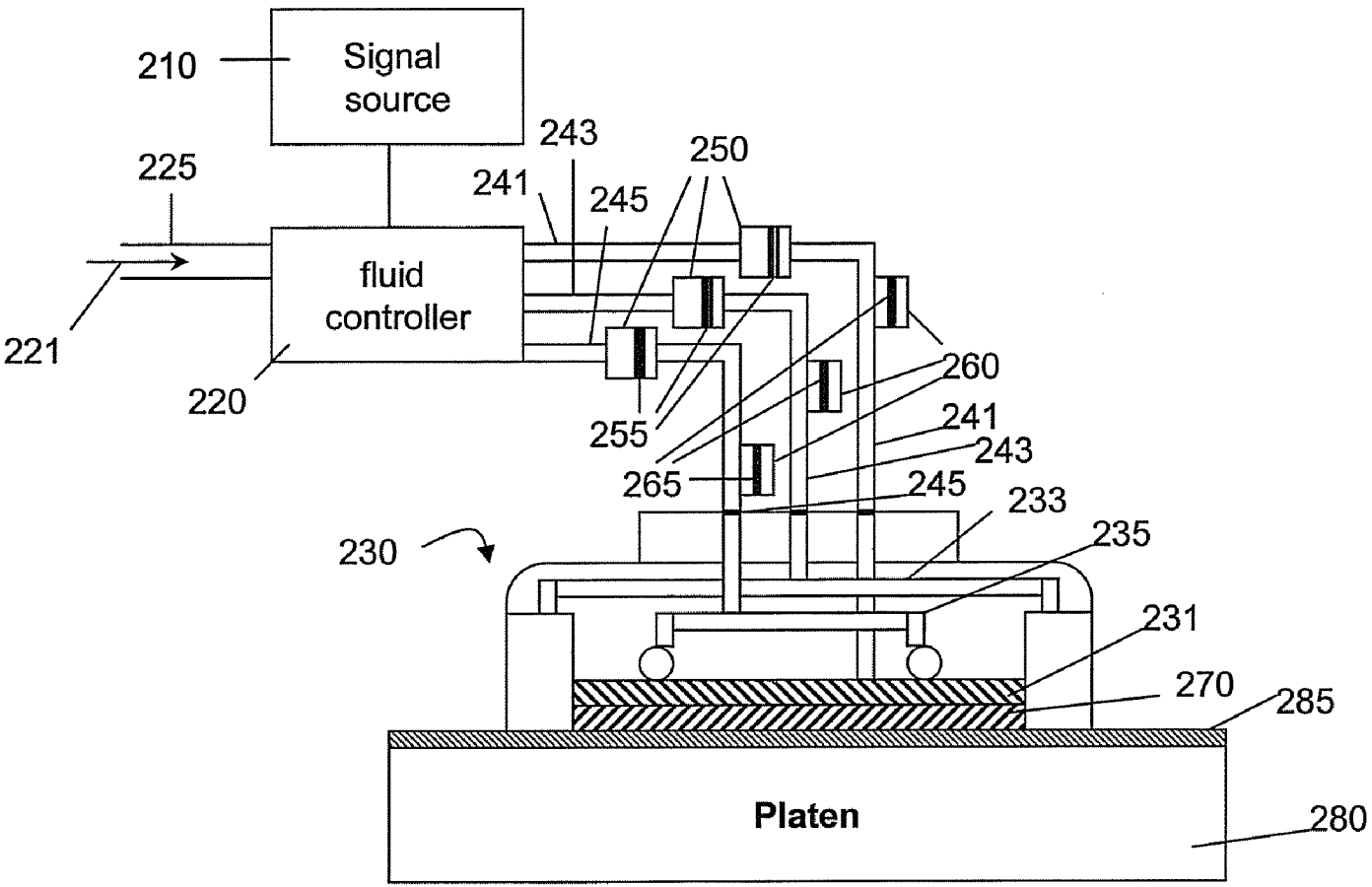
FIG. 2A is a schematic cross-sectional view showing an exemplary chemical mechanical polish (CMP) apparatus.

FIG. 2A is a schematic cross-sectional view showing an exemplary chemical mechanical polishing (CMP) apparatus.

The CMP apparatus comprises a signal controller 210, a fluid controller 220, a polishing apparatus 230, conduits (which may include a membrane conduits 241, a retaining ring conduit 243 and an inner tube conduit 245), chambers 250 having respective fluid interface membranes 255 and optional ultrasonic devices 260 having respective membranes 265. The signal controller 210 is coupled to the fluid controller 220. The polishing apparatus 230 is fluidly coupled to the fluid controller 220 by way of at least one of the conduits 241, 243 and 245. The enclosures 250, which may be gas-to-liquid pressure converters, are disposed within or on the respective conduit 241, 243 and 245. The optional ultrasonic devices 260 are fluidly coupled to the fluid interface membrane 255 by way of the membranes 265 and to the polishing apparatus 230. Although FIG. 2A shows three conduits 241, 243 and 245, any number of conduits may be used, including one, two, four, or the like.

Referring to FIG. 2A, the signal controller 210 is coupled to the fluid controller 220 to generate at least one signal to control the fluid controller 220. In some embodiments, the signal controller 210 controls the pressure of a gas 221 flowing from the input end of the fluid controller 210 by way of the conduit 225. The signal controller 210 thus controls the pressure of the gas 221 in the conduits 240. The gas 221 can be, for example, air, nitrogen, inert gas or other gas.

In some embodiments, the signal controller 210 is not used if the fluid controller 220 can automatically control the pressure of the gas 221 within the conduits 241, 243 and 245. In some embodiments, the fluid controller 220 comprises an upper pneumatic assembly (UPA) or other apparatus which is adapted to control the pressure of the gas 221 that is injected into the conduits 241, 243 and 245.

In some embodiments, the fluid interface membrane 255 can be, for example, rubber. The fluid interface membrane 255 may have a radius between about 100 millimeter (mm) and about 200 mm and a thickness between about 0.3 mm and about 5 mm.

Figure 2B:
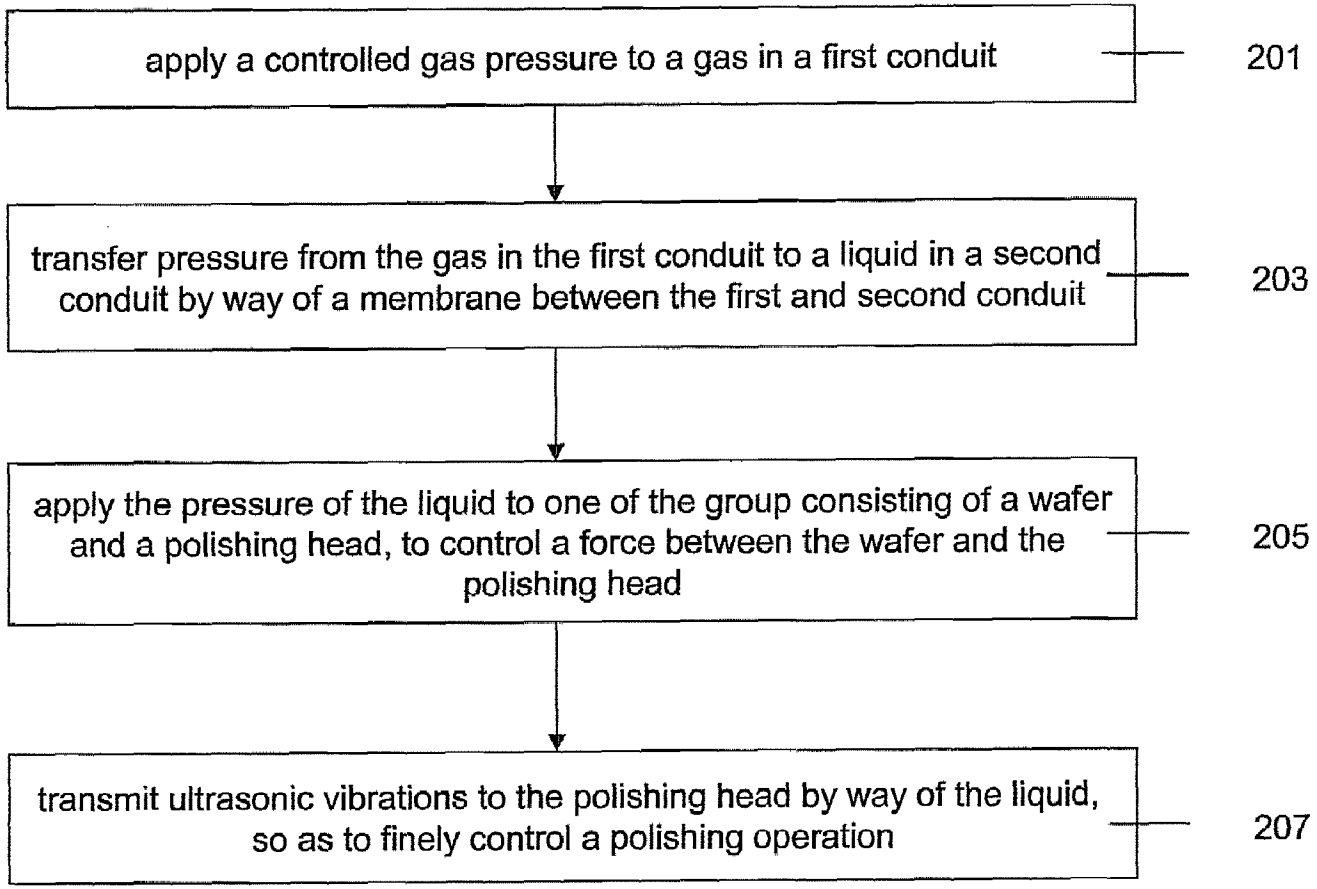
FIG. 2B is a flowchart showing an exemplary polishing method.

FIG. 2B is a flowchart showing an exemplary polishing method. In some embodiments, the polishing method comprises:

Step 201 to apply a controlled gas pressure to a gas in a first conduit;

Step 203 to transfer pressure from the gas in the first conduit to a liquid in a second conduit by way of a membrane between the first and second conduit;

Step 205 to apply the pressure of the liquid to one of the group consisting of a wafer and a polishing head, to control a force between the wafer and the polishing head; and Step 207 to transmit ultrasonic vibrations to the polishing head by way of the liquid, so as to finely control a polishing operation. Detailed descriptions are described below.

Figure 3:
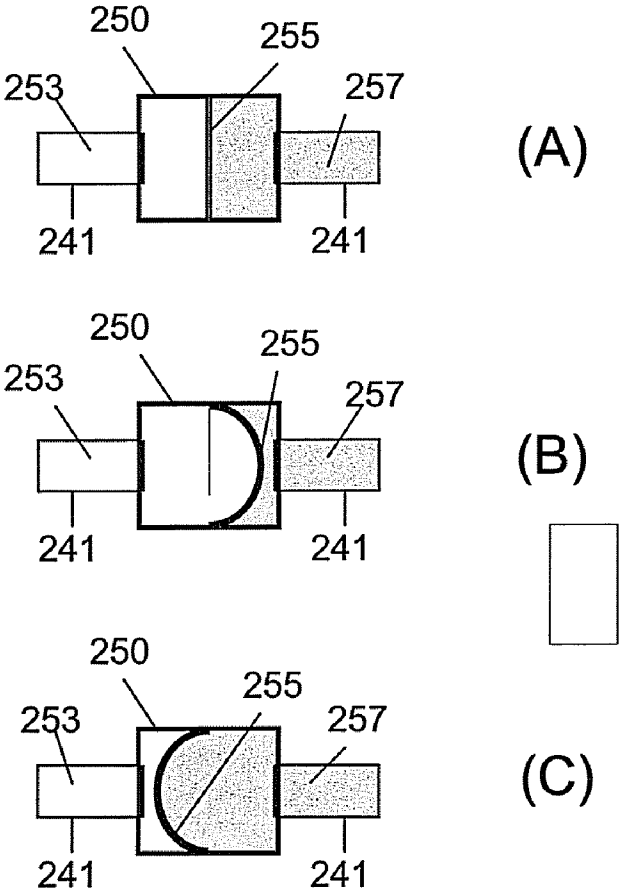
FIGS. 3A-3C are enlarged drawings of the enclosures 250 shown in FIG. 2A.

FIGS. 3A-3C are enlarged plots of the enclosures 250 (e.g., gas-to-liquid pressure converters) connected to the membrane conduit 241 shown in FIG. 2A. In FIG. 3A, the fluid interface membrane 255 is configured within the enclosure 250. The fluid interface membrane 255 separates two fluids 253 and 257. The fluids 253 and 257 can be two gases, a gas and a liquid or two liquids. In a preferred embodiment, the fluid interface membrane 255 separate a gas 253 and a liquid 257 within the membrane conduit 241. The pressure of the gas 253 is transferred to the liquid 257 by way of the fluid interface membrane 255. In some embodiments, the gas 253 is the same as the gas 221. The fluid 257 can be, for example, water, oil or other fluid that is adapted to receive the pressure from the gas 253. By receiving the pressure, the pressure of the liquid 257 is transferred to the polishing apparatus 230.

FIG. 3A represents a balance of the gas pressure and the liquid pressure so that the fluid interface membrane 255 is not pressed towards either the gas 253 or the liquid 257. FIG. 3B represents a situation under which the gas pressure is substantially higher than the liquid pressure so that the fluid interface membrane 255 is pressed toward the liquid 257. FIG. 3C represents a situation under which the gas pressure is substantially lower than the liquid pressure so that the fluid interface membrane 255 is pressed toward the gas 253. Accordingly, the liquid pressure within the membrane conduit 241 is determined by the gas pressure at the opposite side of the fluid interface membrane 255. Because liquids are incompressible, the liquid pressure in the membrane conduit 241 inherently applies a downward force to the polishing apparatus 230. Due to the pressure transfer, the downward force from the liquid pressure is lower than the gas pressure described above with reference to FIG. 1.

In some embodiments, the fluid interface membrane 255 is configured within the membrane conduit 241 without the enclosure 250 (i.e., the membrane conduit 241 is continuous). In still other embodiments, the fluid interface membrane 255 is configured within the fluid controller 220 or the polishing apparatus 230. For example, the enclosure(s) 250 may be configured within the fluid controller 220 or the polishing apparatus 230, and the fluid interface membrane(s) 255 correspondingly configured within the enclosure(s) 250 to separate the fluids 253 and 257 and transfer the pressure from the fluid 253 to the fluid 257. The configuration of the fluid interface membrane 255 shown in FIG. 2 is merely one exemplary embodiment. The present invention, however, is not limited thereto.

Figure 4A:
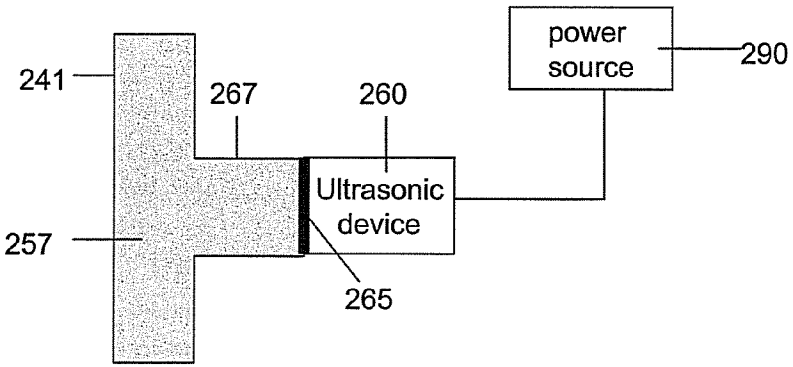
FIG. 4A is an enlarged plot of the ultrasonic device 260 shown in FIG. 2A.
Figure 4B:
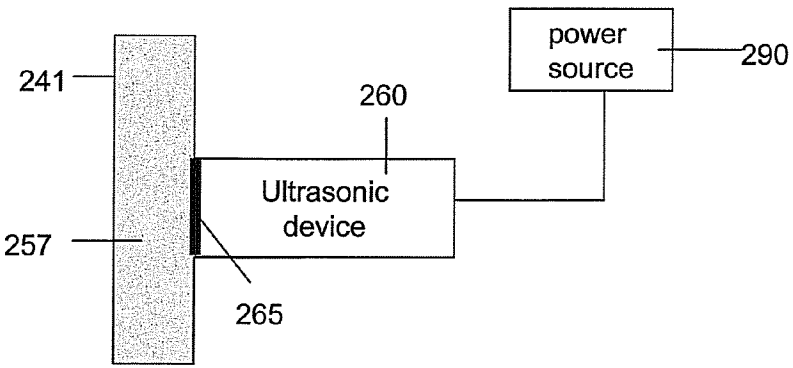
FIG. 4B is a schematic drawing of an exemplary ultrasonic device configured to a conduit.

FIG. 4A is an enlarged diagram of the ultrasonic device 260 coupled to the membrane conduit 241 as shown in FIG. 2A. The membrane 265 is configured between the ultrasonic device 260 and the fluid 257. The ultrasonic device 260 is coupled to the membrane conduit 241 by way of a branch conduit, such as a tee 267, a wye (not shown), or the like. In some embodiments, the ultrasonic device 260 is coupled to the membrane conduit 241 between the fluid interface membrane 255 configured within the enclosure 250 and the polishing apparatus 230. In other embodiments, the ultrasonic device 260 is directly connected to the membrane conduit 241 by way of the membrane 265 without the branch conduit 267 as shown in FIG. 4B. In still other embodiments, the membrane 265 of the ultrasonic device 260 completely surrounds the membrane conduit 241 so that the ultrasonic device 260 can transmit more ultrasonic waves to the fluid 257 within the membrane conduit 241.

Again referring to FIG. 4A, in some embodiments, a power source 290 such as a generator 290 is coupled to and provides power to the ultrasonic device 260. The ultrasonic device 260 then transmits ultrasonic waves to the fluid 257 by way of the membrane 265. The fluid 257 receives the ultrasonic waves, and ultrasonic waves are delivered to the polishing apparatus 230. The ultrasonic waves are transmitted to the rear of the wafer, causing ultrasonic vibrations in the wafer 270 for finely controlled polishing adjustments. The ultrasonic waves also slightly increase the pressure within the fluid 257 in the membrane conduit 241. The pressure applies a downward force to the polishing apparatus 230 as shown in FIG. 2A. By the downward force generated from the ultrasonic device 260, polishing efficiency and the wafer surface profile can be improved, especially for a substrate 270 with a low-k dielectric material thereon. The positioning of the ultrasonic device 260 is not limited to that shown in FIG. 2A. For example, the ultrasonic device 260 can be configured proximate to the polishing apparatus 230 so that the pressure of the fluid 257 from the ultrasonic waves can be efficiently transferred to the polishing apparatus 230.

As described above, the enclosure 250 and/or the fluid interface membrane 255 may be configured within the fluid controller 220 and/or the polishing apparatus 230. The ultrasonic device 260 thus may be fluidly coupled to the fluid controller 220 and/or the polishing apparatus 230. For example, the ultrasonic device 260 also may be configured within the fluid controller 220 and/or the polishing apparatus 230 to provide desired ultrasonic waves to the fluid 253 or the fluid 257. In some embodiments, a power applied to the ultrasonic device 260 can be, for example, from about 1 watt to about 100 watts. The frequency generated by the ultrasonic device 260 can be from about 100 Hz to about 10 MHz.

In some embodiments, the ultrasonic device 260 is not used; for example, device 260 may be either be turned off or omitted if the fluid interface membrane 255 configured within the enclosure 250 provides a sufficient downward force and sufficiently precise control of the downward force for polishing. One of ordinary skill in the art can readily combine the conduits 241, 243 and 245, fluid interface membrane 255, ultrasonic devices 260 and membranes 265 to form a desired polishing apparatus.

In other embodiments (not shown), in which the fluid interface membrane 255, configured within the enclosure 250, provides a sufficient downward force and sufficiently precise control, the ultrasonic devices 260 may be omitted from any one or more of the conduits 241, 243 and/or 245.

In some embodiments, the membrane 265 can be a material, such as rubber, for example. The membrane 265 may have a radius between about 100 millimeter (mm) and about 200 mm and a thickness between about 0.1 mm and about 10 mm.

Again referring to FIG. 2A, in some embodiments, the polishing apparatus 230 comprises at least one of a membrane 231, a retaining ring 233 and an inner tube 235. In some embodiments, the polishing apparatus 230 can be, for example, a chemical mechanical polishing (CMP) head or other polishing apparatus. The membrane 231 is coupled to the membrane conduit 241 and disposed within the polishing apparatus 230 to receive the pressure transferred from the fluid 253 within the membrane conduit 241, the pressure generated from the ultrasonic device 260 or both. The received pressures then apply a downward force on the backside of the substrate 270 by way of the membrane 231 so that the substrate 270 is polished by a pad 285 on a platen 280.

The retaining ring 233 is coupled to the retaining ring conduit 243 and disposed within the polishing apparatus 230 to confine the substrate 270 within the polishing apparatus 230 when the substrate 270 is polished. The pressure applied to the retaining ring 233 is formed in a manner similar to that described in connection with the membrane 231. The pressure applied to the retaining ring 233 effectively confines the substrate 270 in the polishing apparatus 230. The positioning of the enclosure 250, the fluid interface membrane 255, the ultrasonic device 260 and the ultrasonic membrane 265 on or in the retaining ring conduit 243, for example, can be similar to that set forth in connection with the membrane conduit 241. Detailed descriptions are not repeated.

An inner tube 235 is provided to control the profile of the substrate 270 when the substrate 270 is being polished. The pressure transmitted through the inner tube 235 is formed by the same mechanism described in connection with the membrane 231. The pressure received by the inner tube 235 applies a downward force on the backside of the substrate 270 so that the substrate 270 can be polished by the pad 285 on the platen 280. The configuration of the enclosure 250, the fluid interface membrane 255, the ultrasonic device 260 and the ultrasonic membrane 265 on or in the inner tube conduit 245, for example, can be similar to that set forth in connection with the membrane conduit 241. Detailed descriptions are not repeated. Based on the description set forth above, one of ordinary skill in the art can readily combine the conduits 241, 243 and 245, fluid interface membranes 255, membranes 265, ultrasonic devices 260, membrane 231, retaining ring 253 and inner tube 255 to form a desired polishing apparatus.

Although examples are described above in which the apparatus is used to control a downward force exerted by the wafer against the polishing head, one of ordinary skill can readily use the techniques described above to control an upward force exerted by the polishing head against the wafer. Similarly, although examples are described above in which the ultrasonic transducer transmits vibrations to the polishing head by way of the fluid, in other embodiments, the transducer transmits vibrations directly to the polishing head 230 or the platen 280, or to the platen 280 by way of a fluid conduit (not shown). In further embodiments, the ultrasonic transducer transmits vibrations to the polishing slurry used between the wafer and the polishing pad.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. An apparatus, comprising:

a fluid controller;

a polishing apparatus fluidly coupled to the fluid controller by way of at least one conduit; and a fluid interface membrane disposed within at least one of the fluid controller, the conduit and the polishing apparatus to separate a gas and a liquid and to transfer pressure from the gas to the liquid, wherein pressure in the liquid is applied to control polishing by the polishing apparatus; and an ultrasonic device fluidly coupled to the conduit, wherein the ultrasonic device is configured to transmit ultrasonic waves to the liquid so as to generate a downward force to the polishing apparatus.

2. The apparatus of claim 1, wherein the ultrasonic device is fluidly coupled to the conduit by way of a branch conduit between the fluid interface membrane and the polishing apparatus.

3. The apparatus of claim 1, wherein the ultrasonic device is fluidly coupled to the fluid controller, the conduit or the polishing apparatus by way of a membrane.

4. The apparatus of claim 1, wherein the fluid controller comprises an upper pneumatic assembly (UPA).

5. The apparatus of claim 1, wherein the polishing apparatus comprises a chemical mechanical polish (CMP) head having at least one of a membrane, retaining ring and inner tube.

6. The apparatus of claim 5, wherein the conduit comprises a membrane conduit, a retaining ring conduit and an inner tube conduit connected to the membrane, retaining ring and inner tube, respectively.

7. The apparatus of claim 1, wherein the fluid interface membrane is configured within an enclosure disposed within the fluid controller, conduit or polishing apparatus.

8. The apparatus of claim 1, wherein the fluid interface membrane has a radius between about 100 millimeter (mm) and about 200 mm and a thickness between about 0.3 mm and about 5 mm.

9. The apparatus of claim 1, further comprising a signal source, wherein:

the fluid controller is coupled to the signal source to receive at least one signal to control the fluid controller;

the polishing apparatus includes a chemical mechanical polishing (CMP) head fluidly coupled to the fluid controller by way of the at least one conduit;

the fluid interface membrane is configured within at least one enclosure disposed within or on the at least one conduit; and the ultrasonic device is fluidly coupled to at least one of the group consisting of the CMP head and the at least one conduit.

10. The apparatus of claim 9, wherein the fluid controller comprises an upper pneumatic assembly (UPA).

11. The apparatus of claim 9, wherein the CMP head comprises at least one of a second membrane, retaining ring and inner tube.

12. The apparatus of claim 11, wherein the conduit comprises a membrane conduit, retaining ring conduit and inner tube conduit connected to the second membrane, retaining ring and inner tube, respectively.

13. The apparatus of claim 9, wherein the fluid interface membrane has a radius between about 100 millimeter (mm) and about 200 mm and a thickness between about 0.3 mm and about 5 mm.

14. The apparatus of claim 9, wherein the fluid controller comprises an upper pneumatic assembly (UPA); the at least one conduit comprises a membrane conduit, a retaining ring conduit and an inner tube conduit coupled to the UPA, the UPA controlling flows of the gas within the membrane conduit, the retaining ring conduit and the inner tube conduit; the CMP head comprises a membrane, a retaining ring and an inner tube coupled to the membrane conduit, the retaining ring conduit and the inner tube conduit, respectively; the at least one enclosure includes a respective enclosure on each of the membrane conduit, the retaining ring conduit and the inner tube conduit and between the UPA and the CMP head, each enclosure comprising a fluid interface membrane to separate the gas and liquid within one of the membrane conduit, the retaining ring conduit and the inner tube conduit, respectively and to transfer pressure from the gas to the liquid; and the ultrasonic device is fluidly coupled to each of the membrane conduit, the retaining ring conduit and the inner tube conduit and is positioned between the enclosure and the CMP head, the ultrasonic device transferring an ultrasonic wave via the liquid to at least one of the membrane, retaining ring and inner tube.

* * * * *